US006046413A

United States Patent [19]

Simonis et al.

[11] Patent Number: 6,046,413

[45] Date of Patent: Apr. 4, 2000

[54] SWITCH WITH LIFT-OFF RAMP

[75] Inventors: Karl Simonis, Kirchheim; Walter Hecht, Bietigheim-Bissingen; Rudolf Klein, Lauffen, all of Germany

[73] Assignee: ITT Manufacturing Enterprises, Inc., Wilmington, Del.

[21] Appl. No.: 09/101,911

[22] PCT Filed: Jan. 10, 1997

[86] PCT No.: PCT/EP97/00093

§ 371 Date: Dec. 1, 1998

§ 102(e) Date: Dec. 1, 1998

[87] PCT Pub. No.: WO97/26672

PCT Pub. Date: Jul. 24, 1997

[30] Foreign Application Priority Data

Jan. 20, 1996 [DE] Germany ..... 196 01 985

[51] Int. Cl.[7] ..... H01H 19/02; H01H 1/00; H01H 15/02; H01H 21/02

[52] U.S. Cl. ..... 200/11 EA; 200/11 J; 200/11 K; 200/16 C; 200/16 D; 200/252

[58] Field of Search ..... 200/16 R, 16 C, 200/16 D, 11 J, 11 EA, 291, 292, 61.27–61.38, 61.54, 252–257

[56] References Cited

U.S. PATENT DOCUMENTS

| | | | |
|---|---|---|---|
| 3,549,832 | 12/1970 | Ferryman, Jr. | 200/16 C |
| 3,598,934 | 8/1971 | O'Connor, III | 200/16 R |
| 4,012,608 | 3/1977 | Lockard | 200/16 D |
| 4,168,404 | 9/1979 | Lockard | 200/16 D X |
| 4,417,107 | 11/1983 | Terajima | 200/16 C |
| 4,491,703 | 1/1985 | Jaklic | 200/16 D |
| 4,841,105 | 6/1989 | Goodman et al. | 200/16 D |
| 4,897,013 | 1/1990 | Oka et al. | 200/11 EA |
| 5,898,142 | 4/1999 | Ohtaki et al. | 200/16 C |

FOREIGN PATENT DOCUMENTS

| | | | |
|---|---|---|---|
| 1445150 | 12/1966 | France | H01H 21/00 |
| 1171499 | 6/1964 | Germany . | |
| 2017348 | 10/1970 | Germany | H01H 19/54 |
| 2018559 | 10/1970 | Germany . | |
| 2524287 | 12/1975 | Germany . | |
| 3315994 | 11/1984 | Germany | H01H 21/76 |
| 4020821 | 1/1992 | Germany . | |
| 4226508 | 2/1994 | Germany . | |

OTHER PUBLICATIONS

English translation of the International Preliminary Examination Report for PCT/EP97/00093.

*Primary Examiner*—J. R. Scott
*Attorney, Agent, or Firm*—J. Gordan Lewis

[57] ABSTRACT

The invention describes a switch, preferably a steering column switch, provided with an actuating member moved across the contact sections rigidly connected to the housing in a substantially pushing way. It is the object of the invention to provide a steering column switch which, being of a small-sized design, permanently provides for good contact making between the contacts to be interconnected. This problem, in the practice of the invention, is solved by ramps raising the contact bridge in the transitory area. Advantageous embodiments refer to the design of the ramp of the conductor bank and of the contact bridge.

14 Claims, 3 Drawing Sheets

SWITCH WITH LIFT-OFF RAMP

TECHNICAL FIELD

The present invention is concerned with a switch for automotive vehicles, in particular, steering column switches.

BACKGROUND OF THE INVENTION

Switches of the afore-mentioned type, on the one hand, should be able to switch substantial load currents so as to pass energy to lamps and engines. On the other hand, switches of the afore-described type increasingly serve for indirectly actuating power consuming units then actuated directly through electronic circuits. Advantageously, steering column switches of this type should, therefore, also be able to switch weak control currents.

In order to be able to neatly switch also weak flows of this type, the transition resistance of the switches is to be kept low. Special provision is, therefore, to be made to prevent pollution of the communicating contact faces by corrosion, scaling, arc formation or adhering residual insulating material.

In conventional switches, contact sections rigidly arranged on the housing in abutting relationship within the contact plane are electrically interconnected or separated by a pushing motion of contact bridges. The disadvantage involved with switches of this type resides in that the two contact sections are separated by insulating material that will get into close contact with the contact bridge when sweeping about it. The displaced contact bridge will thereby entrain remainders of insulating material or of the plastic casing in which are embedded the contact sections. Once the contact bridge runs up another contact section, the insulating material, in part, is transferred to the contact bank of the said contact section or is burnt into the contact faces by the arc, if formed, thereby polluting the contact face. By sizing the switch adequately large, the bearing force of the contacts can so be dimensioned that during the counter-directed pushing motion the contacts are again rubbed clean. However, large-dimensioned switch sizes are not justifiable for weak currents.

It is the object of the invention to provide a small-sized switch, the contact faces of which are substantially kept free from pollution so as to enable use thereof as a switch for large and weak currents. Hence, the invention resides in that the contact bridge is raised at an appropriate point before leaving a contact section to be then lowered at an appropriate point of a new contact section.

Accordingly, the pushing motion, at the important re-switching points, is combined with a lifting motion. The resultant advantage resides in that the actual contact face is not placed in contact with the insulating material surrounding the contact sections. Moreover, contact making, due to the lifting motion, is abruptly changed rather than linearly by a dragging movement through passage from one contact section to the next. Hence, three defined conditions of the contact bridge are attained in respect of which the transitory times are relatively short, to wit: contact making of the contact bridge in one contact section only; contact making of the bridge to one bridge portion only with the other bridge portion lifted off; and, finally, rapid transition to the condition connecting the two contact portions respectively to another contact section. Also, it is of importance to the invention that one of the contact portions, during lifting, does not yet form an arc because the other contact portion is still in close electrical contact with the contact section.

A particularly simple design suitable for lifting off a contact portion is disclosed according to which a ramp is provided over which a contact portion of the contact bridge moving along a contact section is raised in a direction vertical to the plane of the contacts and lowered over the next contact section. Hence the motion of the contact portion follows the oblique sloping ramp faces.

To reliably prevent areas of the contact bridge dragging along the stationary contact sections from getting into contact with the surrounding insulating material, in particular, with the insulating material of the ramp, at least one ramp is provided which is arranged laterally of the contact faces of contact bridge and contact section so that the area of the contact bridge running on the ramp will not get into contact with the contact face on the contact sections.

To that extent, a particularly simple design is set out wherein the ramps are symmetrically arranged within the interval so that the forces exerted by the two ramps on the contacts are also symmetrical, thereby keeping the contact bridge well in trace with the contact sections. To reliably separate the portions of the contact bridge in communication with the ramp or insulting material, if any, from the portions serving to establish contact with the contact sections, the contact zones previously referred to as contact portions are formed on the contact bridge that get into electrical contact with the ramps but not with the contact sections. Moreover, contact zones are formed that exclusively get into contact with the contact sections to establish a reliable electrical contact.

To improve contact making between contact bridge and contact section, a preferred embodiment is disclosed for conducting weak currents as due to the dragging motion of contacting faces that, conversely, never get into contact with plastic material and are easily separated with no major arc formation, the contact faces can be kept substantially clean. Usually, no special coating is required.

For further reducing the contact face to facilitate cleaning of the contacts, contacts can be constructed having a pointed bearing face for the contacts. If in several bridges moving in parallel on contact sections, different currents are to be conducted it may, be advisable to provide some of the bridges, in the direction of the contact sections, with grooves laterally embracing the contact banks, thereby selectively providing a larger contact face. However, if exclusively control currents are to be switched, it is adequate for the bridge not to be furnished with grooves and to reduce the bearing face of the contact bridge on the contact bank accordingly.

To improve contact making of the contact bridge, the contact bridge is resiliently guided in an actuating member in a direction vertical to the contacting plane. Due to the flexible abutment of the contact bridge on the contact banks, a safe bearing pressure even in the event of irregularities of the contact bank is ensured. Moreover, an elevated spring pressure can be used for mutually keeping clean the contact faces.

The present invention provides for a reliable guidance of the contact bridge within the actuating lever so that the bridging contact, toward the contact banks, always remains in alignment with the contact sections, preventing deflection from the direction of extension of the contact banks.

Another advantage resides in that the distance covered by the contact bridge toward the contact bank is limited involving special advantages for the assembly of the actuating lever within which the movable contact bridge is safely and rigidly held.

In a preferred embodiment, stops are used as projections on lugs for engaging associated guiding slots within the actuating member. By enabling the contact bridges to engage the actuating lever, easy assembly, movable guidance over the actuating lever and safe arrangement thereover to prevent loss thereof is obtained.

The present invention is suitable for use with slide switches in which the bridging contact performs a straightforward movement. However, the invention is also suitable for use with contact sections and contact banks, respectively, which are arranged in series at an angle, wherein the contact banks themselves also can be of a curved configuration. It is particularly advantageous for the contact banks to be unidirectionally curved on the contact sections and to be arranged with the same radius of curvature in series. A design of this type is particularly suitable for steering column switches in which the actuating lever performs a swivel movement about a fulcrum resulting in a circular sector-type movement of the bridging contact.

A simple design for the contact banks is disclosed wherein the contact bank can be formed from the contact sections by stamping so that a contact section of that type can also be punched from a simple contact plate.

Another simplification is disclosed in that molded to the contact sections stamped from contact plate are plug connections. Advantageously, the contact sections can be formed from a punching grid. In order to enable the individual contact banks to be more easily placed and held in an injection mold, they are, in addition, connected, during the injection process, to electrically conducting, mechanically connecting bridges that, after the injection operation, are severed by punching, irrespective of whether or not the said severing webs are coated by extrusion with plastic material.

In order to further reduce the bearing face of the contact bridge, the two contact sections serving both for guiding the contact bridge through the ramps and for contact making, in the direction of extension of the contact banks, are spatially separated from one another and are electrically interconnected. The contact areas also can be punched from a single contact plate and can be formed by subsequent deformation, with the two contact areas, advantageously, being electrically interconnected by a web. Suitably, a centering projection can be molded into the said mechanically rigid web with the said centering projection forming a point of attack for the preloading spring. As the contact areas have both a mechanical control function over the associated ramp and a contact-making function over the contact section rigidly connected to the casing, in a preferred embodiment, the contact area includes a curved surface thereby safeguarding that the contact bridge is prevented from interlocking with the ramp. In addition, the slope of the ramp is to be comparatively flat, normally not to exceed 2/10 mm, thereby preventing, in particular, switch noises from occurring and extending the operating life of the switch.

DETAILED DESCRIPTION OF THE PREFERRED EMBODIMENTS

Figure 1:
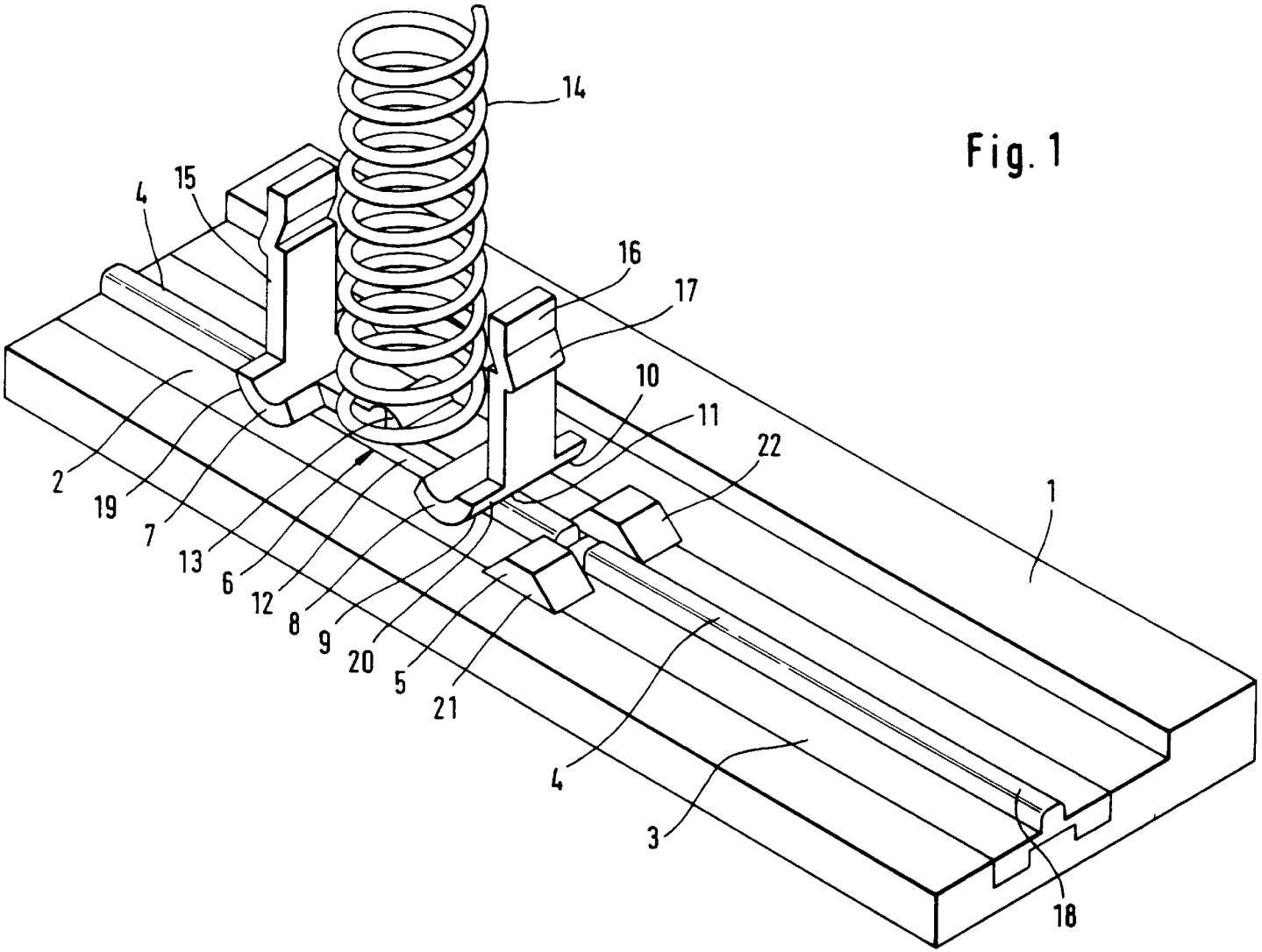
FIG. 1 is a schematically shown three-dimensional view of a cut from a switch housing with injection-molded contact banks and a contact bridge seated thereon.

Referring to the drawings, FIG. 1 shows the bottom face 1 of a switch according to the invention into which are cast the contact sections 2,3. The two contact sections are electrically separated at the level of dual ramp 5, it being possible for the ramp to be injection-molded along with the molding of the bottom face 1 so as to be formed integrally with the bottom face of the same material. Contact banks 4 are molded from the contact section 2,3 by stamping, with a contact bridge 6 with the two contact areas 7 and 8 thereof being seated on the contact bank 4 of the contact section 2.

Each of the two contact areas 7,8 comprises contact zones 9,10 and 11, respectively, with the contact zones 9,10 running up the ramp 5, while the contact zone 11 exclusively serves for making contact with the associated contact bank 4 of the contact section 2. The two contact areas 7,8 are interconnected by a bridging member 12 configured as a web that includes a centering projection 13 fixing the point of attack of a spring 14. The spring is supported with the end being the free end in FIG. 1 on an actuating lever of a steering column switch (not shown) simultaneously engaged by two lugs 15,16 serving for guiding the contact bridge 6 in the actuating lever.

Projections 17 on lugs 15,16 engage guiding grooves of guiding slots within the actuating lever (not shown), thereby insuring that the contact bridge 6 is immovably or rigidly held with respect to the actuating lever in that the path of movement of the lugs is limited by stops struck by projections 17. DE-OS 42 26 508 discloses substantial elements of the design of the contact bridge 6 so that there is no need for them to be described herein.

The contact banks 4 comprise a curvature 18 whereas the contact areas 7,8 are respectively provided with a curved surface 19,20. The zones 9,10 during movement of the contact bridge 6, will run, in the direction of extension of the contact banks 4, up the two ramps 21,22 of the dual ramp 5, thereby lifting the contact zone 11 from the appertaining contact bank 4. If the contact bridge 6 is continued to be moved in the same direction, the contact zones 9,10 are lowered again; contact zone 11 will then be seated on the contact bank 4 of the contact section 3. As shown in FIG. 1, the contact banks 4 of the contact sections 2,3 can be formed by being punched from the punch grid.

Figure 2:
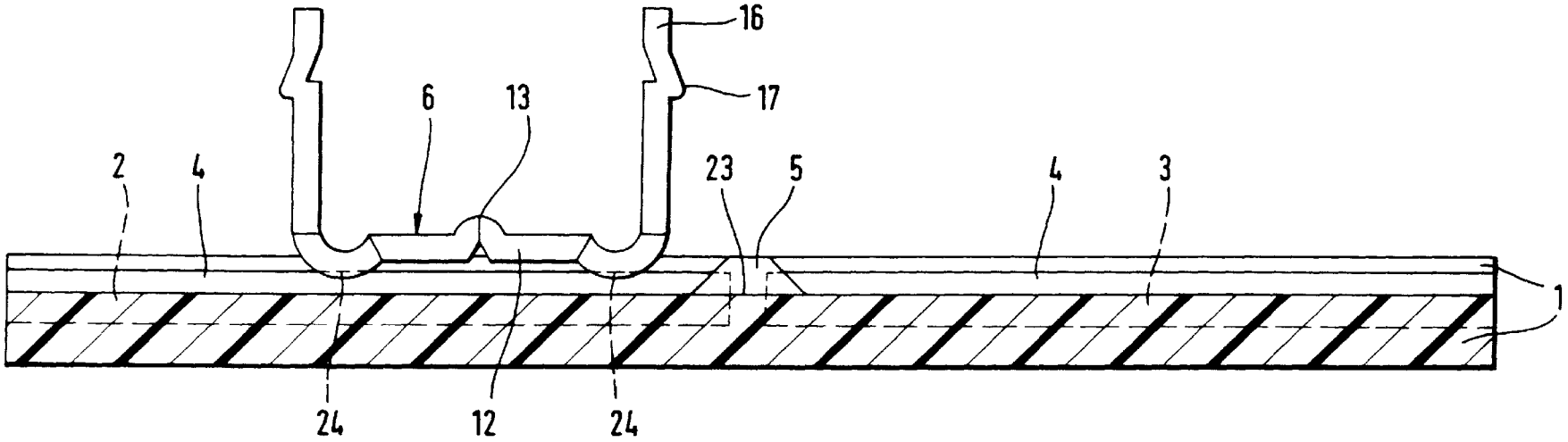
FIG. 2 is a sectional view of the arrangement of FIG. 1 shown laterally of the contact bank.

FIG. 2 is a side view of the contact bridge 6 seated on the contact bank 4 of the contact section 2. The section is arranged slightly laterally of the contact bank so that only a ramp web 23 interconnecting the two partial ramps 21,22 is shown. FIG. 2, through a dashed line, indicates grooves 24 laterally embracing the upper marginal area of the contact bank 4, thereby not only permitting a centered guidance of the contact bridge 6 on the contact bank 4 but also, if need be, an enlarged contact face. FIGS. 1 and 2 additionally disclose that the appertaining contact sections 2,3, in the longitudinal direction thereof, are in alignment with one another; however, they can also be arranged in staggered relationship if the contact bridge 6 is configured accordingly.

Figure 3:
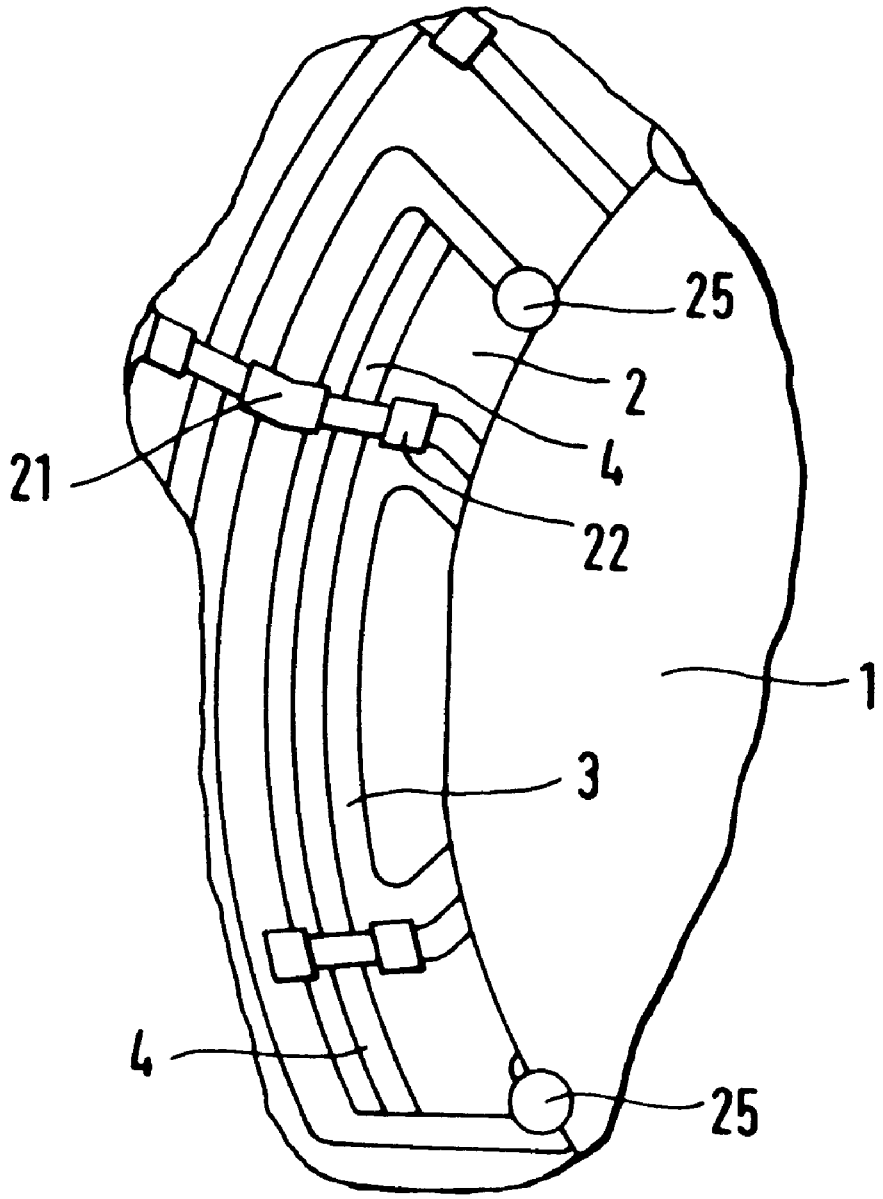
FIG. 3 is a scaled-down plan view of an intermediate bottom of a switch housing with a plurality of injection-molded parallel contact sections.

FIG. 3 additionally shows that curved contact banks 4 can be provided, with plug connections (not shown in the drawing) being molded to appertaining contact sections. However, it can be clearly seen that the contact sections are punched from a contact plate and that, subsequently, connecting webs are severed by punching passage holes there into. This will result in a substantially more complex configuration of the contact sections than shown in FIGS. 1 and 2.

We claim:

1. A switch, comprising:

at least one contact bridge displaceable in a contact plane, said contact bridge including a first and a second contact areas interconnected by a bridging member, said contact bridge being pushable from a separating position to a connecting position and being resiliently guided in a direction vertical to said contact plane by an actuating member arranged within an actuating lever of a steering column switch, the resilient guidance of said contact bridge being provided by a spring acting upon said bridging member, two contact sections including contact banks elevated in a rail-type manner that are electrically separated from each other by an interval and to be interconnected by said first and second contact areas of said contact bridge, said contact sections being rigidly fastened to a switch housing, said first and second contact areas of said contact bridge being arranged in a longitudinal direction of said contact banks in a spaced relationship from one another, at least one ramp arranged laterally of said interval between said contact sections, said first contact area of said contact bridge being provided with at least one ramp zone guided through said at least one ramp, and with at least one contact zone sliding on said contact banks, wherein said contact bridge changes from contacting one of said two contact sections to contacting both of said contact sections during a pushed transition from said separating position to said connecting position, and wherein during said transition said first contact area of said contact bridge is lifted by said at least one ramp over said contact plane from the contact section previously contacted to be lowered thereafter down to the other contact section to be newly contacted.

2. A switch according to claim 1, further including two ramps on both sides of the interval.

3. A switch according to claim 1, wherein the contact banks facing the contact areas are curved such that a small face of contact is formed between the contact banks and the contact areas of the contact bridge.

4. A switch according to claim 1, wherein the contact bridge comprises two lugs substantially extending in the preloading direction of the spring preloading the contact bridge, with the lugs serving for guidance within the actuating member, and two stops are provided confining the path of the contact bridge toward the contact bank.

5. A switch according to claim 4, wherein the stops constitute projections on the lugs engaging associated guiding slots within the actuating member.

6. A switch according to claim 4, wherein the contact banks extending in the contact plane are unidirectionally curved.

7. A switch according to claim 4, wherein the contact banks to be interconnected are in substantial alignment with one another.

8. A switch according to claim 4, wherein the contact banks are punched from the contact sections.

9. A switch according to claim 1, wherein the contact sections are conductor lines punched from sheet metal, with the conductor lines integrally passing to electrical plug connectors.

10. A switch according to claim 1, wherein the contact sections form parts of a sheet metal punch grid embedded in an extruded coating of plastic material, with the conductor lines being severed only after extrusion.

11. A switch according to claim 1, wherein the bridging member is provided with a centering projection centering the point of attack of the spring acting upon the bridging member.

12. A switch according to claim 1, wherein the contact area has a curved surface so curved as to serve as a run-on slope with respect to the ramp.

13. A switch according to claim 1, wherein the contact area is so curved that, in connection with the curvature of the contact bank, it forms a reduced, self-cleaning contact face.

14. A switch according to claim 1, wherein the contact zones of the contact bridge are provided with grooves through the side faces of which the contact zones are laterally guided on the contact banks.

* * * * *